US011131159B1

(12) United States Patent
Nguyen et al.

(10) Patent No.: US 11,131,159 B1
(45) Date of Patent: Sep. 28, 2021

(54) CASING EXIT ANCHOR WITH REDUNDANT SETTING SYSTEM

(71) Applicants: Tuan Nguyen, Pearland, TX (US); Philip M. Gregurek, Pearland, TX (US); Gregory Hern, Porter, TX (US)

(72) Inventors: Tuan Nguyen, Pearland, TX (US); Philip M. Gregurek, Pearland, TX (US); Gregory Hern, Porter, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 21 days.

(21) Appl. No.: 16/829,056

(22) Filed: Mar. 25, 2020

(51) Int. Cl.
*E21B 23/01* (2006.01)
*E21B 29/06* (2006.01)
*E21B 47/00* (2012.01)

(52) U.S. Cl.
CPC ..... *E21B 23/01* (2013.01); *E21B 47/00* (2013.01); *E21B 29/06* (2013.01)

(58) Field of Classification Search
CPC ..... E21B 7/061; E21B 29/06; E21B 29/005; E21B 41/0035; E21B 23/01; E21B 47/00; E21B 7/06
See application file for complete search history.

(56) References Cited

U.S. PATENT DOCUMENTS 3,409,096 A 11/1968 Brown
5,002,131 A 3/1991 Cromar et al.
5,109,924 A 5/1992 Juergens et al.
5,431,220 A 7/1995 Lennon et al.
5,474,126 A 12/1995 Lynde et al.
5,699,858 A * 12/1997 McAnally ..... E21B 23/01 166/106
5,709,265 A 1/1998 Haugen et al.
5,803,176 A 9/1998 Blizzard, Jr. et al.
5,878,818 A 3/1999 Hebert et al.
6,032,740 A 3/2000 Schnitker et al.
6,311,792 B1 11/2001 Scott et al.
6,464,002 B1 10/2002 Hart et al.
6,695,056 B2 2/2004 Haugen
7,878,253 B2 2/2011 Stowe et al.
(Continued)

FOREIGN PATENT DOCUMENTS

EP 0916014 A1 5/1999
WO 2016209686 A1 12/2016

OTHER PUBLICATIONS

"Timken introduces two high performance alloy steel grades" Offshore Magazine, Offshore Staff, Nov. 11, 2013; 5 pages.
(Continued)

*Primary Examiner* — Daniel P Stephenson
(74) *Attorney, Agent, or Firm* — Cantor Colburn LLP

(57) ABSTRACT

An anchor setting system having redundant setting methodologies including a housing having an internal chamber. The housing has an outer surface, an inner surface, a first end, and a second end. A slip is shiftably mounted to the outer surface of the housing. A piston assembly including a piston element is arranged in the housing. The piston element includes a conduit and is shiftably mounted in the internal chamber. An activator is mounted to the piston assembly. The activator selectively shifts the slip axially along the housing in response to movement of the piston element.

26 Claims, 7 Drawing Sheets

(56) References Cited

U.S. PATENT DOCUMENTS

| | | | | |
|---|---|---|---|---|
| 8,327,944 | B2 | 12/2012 | King et al. | |
| 8,967,279 | B2 | 3/2015 | Hered et al. | |
| 9,140,083 | B2 * | 9/2015 | Delgado | E21B 7/061 |
| 10,227,823 | B2 | 3/2019 | Hern et al. | |
| 10,724,319 | B2 | 7/2020 | Hulsewe | |
| 2002/0170713 | A1 | 11/2002 | Haugen et al. | |
| 2004/0238171 | A1 | 12/2004 | McGarian et al. | |
| 2005/0039905 | A1 | 2/2005 | Hart et al. | |
| 2006/0207771 | A1 * | 9/2006 | Rios, III | E21B 23/01 166/382 |
| 2007/0044954 | A1 | 3/2007 | Dewey | |
| 2009/0266544 | A1 | 10/2009 | Redlinger et al. | |
| 2009/0266556 | A1 | 10/2009 | Swenson et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1 | 10/2012 | Gregurek et al. | |
| 2012/0261193 | A1 | 10/2012 | Swadi et al. | |
| 2013/0020084 | A1 | 1/2013 | Goodson | |
| 2013/0299160 | A1 * | 11/2013 | Lott | E21B 23/04 166/88.2 |
| 2015/0152703 | A1 | 6/2015 | Haun | |
| 2016/0238055 | A1 | 8/2016 | Donovan | |
| 2016/0348456 | A1 | 12/2016 | Laplante et al. | |
| 2017/0030168 | A1 | 2/2017 | Akkerman | |
| 2017/0328177 | A1 | 11/2017 | Sheehan et al. | |
| 2018/0209232 | A1 | 7/2018 | Hulsewe | |
| 2018/0209233 | A1 | 7/2018 | Hulsewe | |
| 2018/0320480 | A1 | 11/2018 | Jelly et al. | |
| 2018/0334872 | A1 | 11/2018 | Vuyk | |
| 2019/0003264 | A1 | 1/2019 | Swadi et al. | |
| 2019/0120005 | A1 | 4/2019 | Hulsewe | |
| 2019/0330944 | A1 * | 10/2019 | Crabb | E21B 23/01 |
| 2020/0011134 | A1 | 1/2020 | Nevlud et al. | |
| 2020/0018131 | A1 * | 1/2020 | Telfer | E21B 23/01 |
| 2020/0088001 | A1 * | 3/2020 | Morland | E21B 33/134 |

OTHER PUBLICATIONS

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

* cited by examiner

CASING EXIT ANCHOR WITH REDUNDANT SETTING SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, a window milling system is lowered into the borehole to a selected depth. Once in position, an anchor is deployed to lock the whipstock to the casing. Typically, a setting system shifts a slip axially along a tubular. The slip radially expands and bites into the casing. The setting system may take the form of a hydrostatic actuator, a hydraulic actuator, or a mechanical weight set. If the actuator fails, the drill string must be removed from the borehole for repair. Removing the drillstring to repair the actuator is a time-consuming process. Given the need to increase efficiency at the rig floor, the art would be open to new systems for actuating an anchor for a casing window milling system.

SUMMARY

Disclosed is an anchor setting system having redundant setting methodologies including a housing having an internal chamber. The housing has an outer surface, an inner surface, a first end, and a second end. A slip is shiftably mounted to the outer surface of the housing. A piston assembly including a piston element is arranged in the housing. The piston element includes a conduit and is shiftably mounted in the internal chamber. An activator is mounted to the piston assembly. The activator selectively shifts the slip axially along the housing in response to movement of the piston element.

Also disclosed is a method of activating an anchor in a wellbore including introducing a first setting force to an anchor setting system, sensing that the first setting force did not set the anchor, and introducing a second setting force without reconfiguring the anchor setting system to set the anchor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
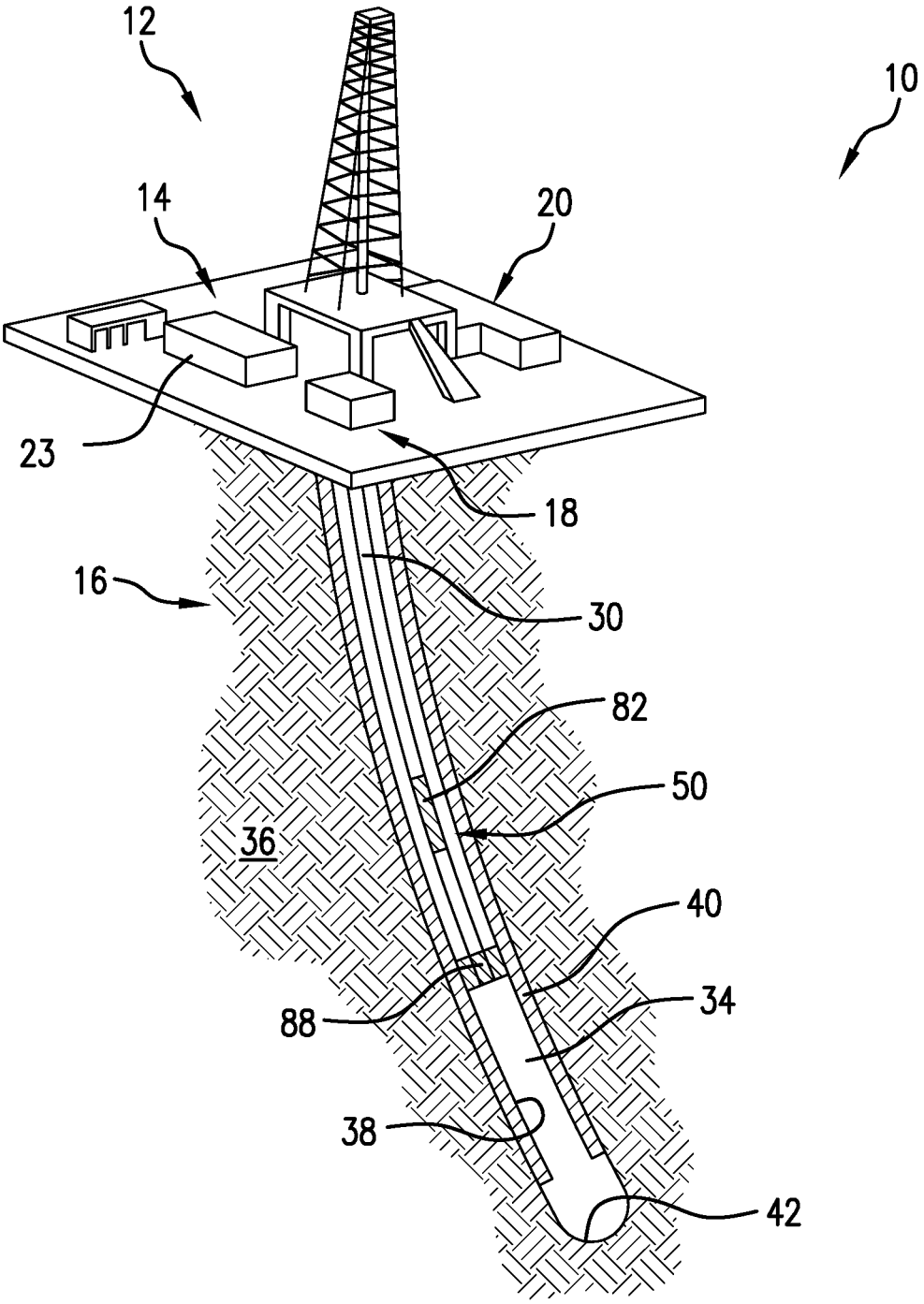
FIG. 1 depicts a resources exploration and recovery system including a redundant setting system, in accordance with an exemplary embodiment.

A resource exploration and recovery system, in accordance with an exemplary embodiment, is indicated generally at 10, in FIG. 1. Resource exploration and recovery system 2 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
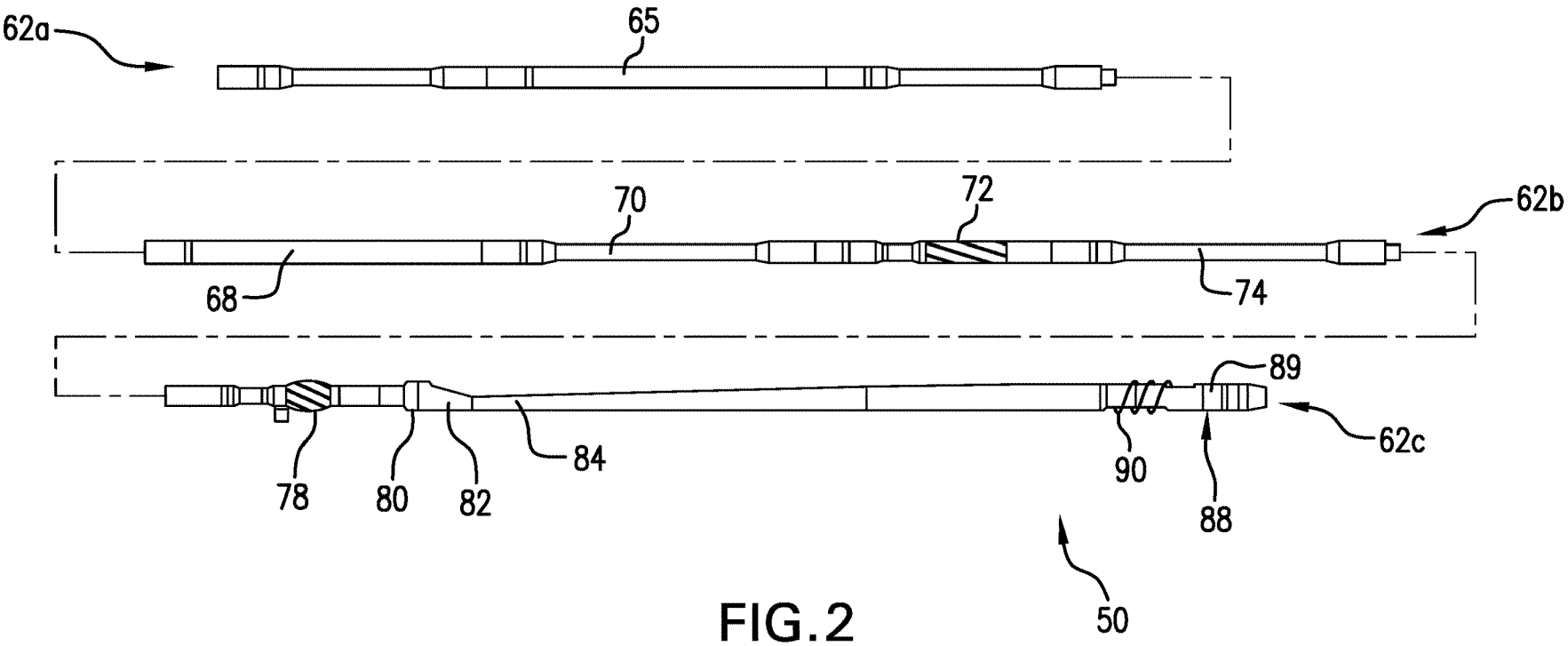
FIG. 2 depicts a window cutting system including a window mill and whipstock connector, in accordance with an exemplary embodiment.

In accordance with an exemplary aspect, a window cutting system 50 is connected to tubular string 30 and is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 that may include one or more slips 89. Whipstock connector 82 serves as an interface between window mill 80 and whipstock 84. As will be detailed herein and shown in FIG. 3, anchor 88 includes a redundant anchor setting system 100. Redundant anchor setting system 100 may set anchor 88 using multiple setting methodologies without the need to reconfigure components of third segment 62*c* or withdraw tubular string 30 from wellbore 34. A scraper or brush 90 may be arranged on third segment 62*c* adjacent to anchor 88. Scraper or brush 90 may engage annular wall 38 so as to remove cement, debris or the like.

Figure 3:
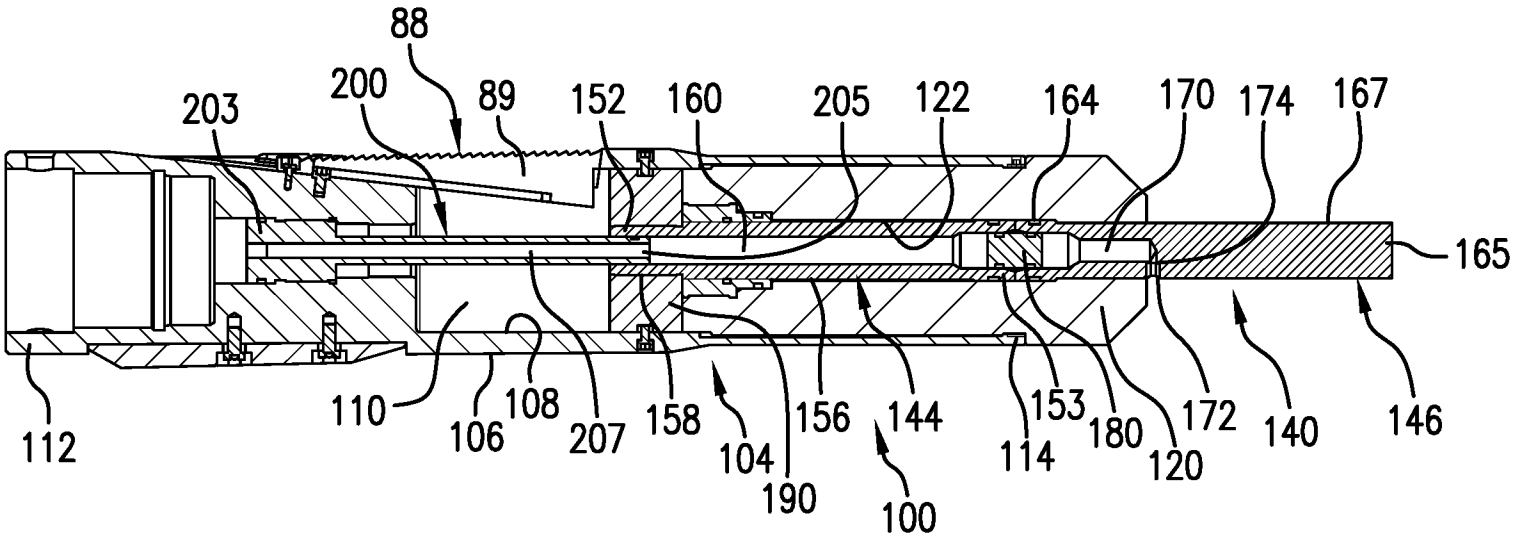
FIG. 3 depicts a setting system in a run-in configuration, in accordance with an aspect of an exemplary embodiment.

Referring to FIG. 3, in an embodiment, anchor setting system 100 includes a housing 104 having an outer surface 106 that supports slips 89 and an inner surface 108 that defines, at least in part, an internal chamber 110. Housing 104 includes a first end 112 and an opposing second end 114.

A guide element 120 is arranged in internal chamber 110 at second end 114. Guide element 120 includes an internal passage 122. Internal passage 122 extends axially through guide element 120.

Anchor setting system 100 further includes a piston assembly 140 arranged in internal chamber 110 and internal passage 122. Piston assembly 140 includes a first piston element 144 and a second piston element 146. First piston element 144 and second piston element 146 may shift axially, either together, or separately within internal passage 122 as will be detailed herein. First piston element 144 includes a first end section 152 and a second end section 153. An outer surface section 156 extends between first end section 152 and second end section 153. A recess 158 is formed in outer surface section 156 at first end section 152. A first conduit 160 extends entirely through first piston element 144 from first end section 152 to second end section 153.

Second piston element 146 includes a first end portion 164 and a second end portion 165. An outer surface portion 167 extends between first end portion 164 and second end portion 165. A second conduit 170 extends partially through second piston element 146. That is, second conduit 170 extends into second piston element 146 from first end portion 164 and stops short of second end portion 165. An opening 172 extends radially through outer surface portion 167 into second conduit 170. A burst disc 174, configured to break at a selected pressure, is positioned at opening 172.

A shuttle 180 is arranged between first piston element 144 and second piston element 146 in first conduit 160 and second conduit 170. Shuttle 180 may be shifted into either first conduit 160 or second conduit 170 when activating anchor 88 as will be discussed herein. An activator 190 is arranged on outer surface section 156 in recess 158. Activator 190 is held in place by one or more shear screws (not separately labeled).

In further accordance with an exemplary aspect, a guide member 200 is arranged in internal chamber 110 axially outwardly of first piston element 144. Guide member 200 includes a first axial end 203 that is fixedly mounted in housing 104 and a second axial end 205 that projects into first conduit 160. A passage 207 extends entirely through guide member 200 from first axial end 203 to second axial end 205.

Figure 4:
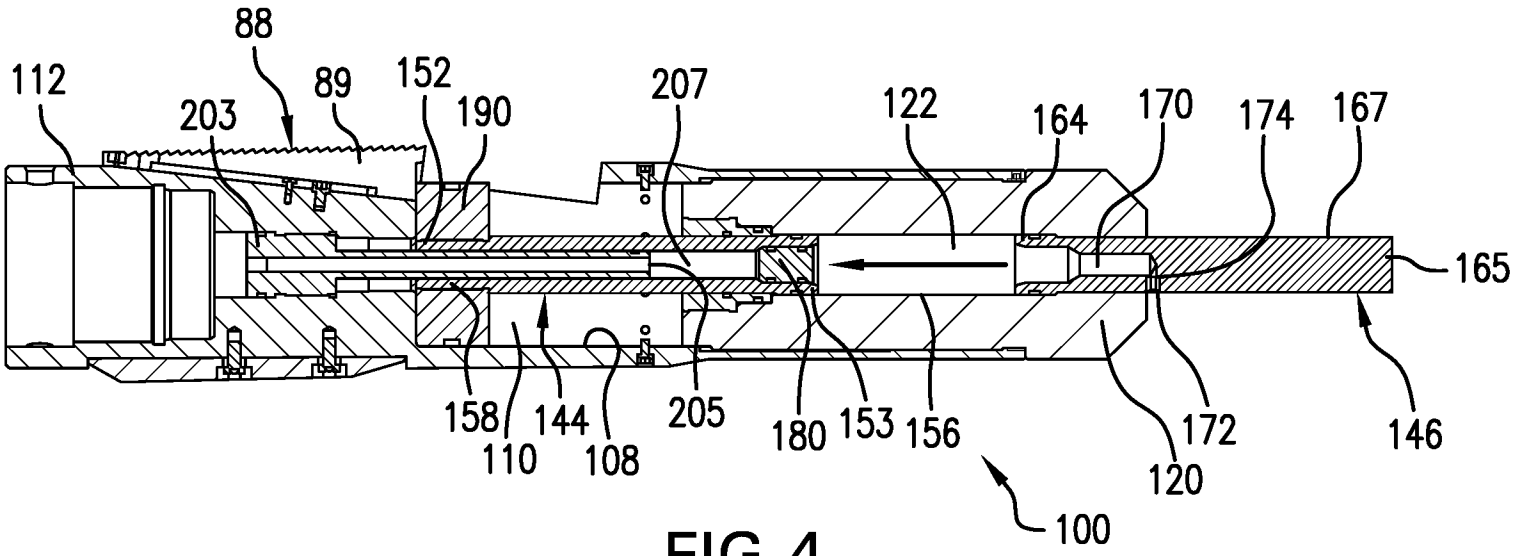
FIG. 4 depicts the setting system during a hydrostatic setting, in accordance with an exemplary embodiment.

Reference will now follow to FIG. 4, wherein like reference numbers correspond to corresponding parts in the respective views in describing a first methodology for deploying anchor 88. Tubular string 30 is run into wellbore 34 to position window mill 80 at a selected depth. Once in position, annular pressure, e.g., the pressure within wellbore 34 around tubular sting 30 is increased to a selected level so as to cause burst disc 174 to rupture. Fluid pressure may then enter opening 172 and flow into second conduit 170.

The fluid pressure entering second conduit 170 drives shuttle 180 into first conduit 160 causing first piston element 144 to shift axially, upwardly breaking the shear screws and driving activator 190 into connect with slip 89. Activator 190 urges slip 89 along an angled surface portion (not separately labeled) of outer surface 106. Slip 89 expands radially outwardly into contact with annular wall 38 to maintain tubular string 30 at a desired position. Operators will shift tubular sting 30 in wellbore 34 to sense whether anchor 88 has been set. If tubular string 30 moves, a second setting methodology may be employed without the need to remove tubular sting 30 from wellbore 34 or reconfigure anchor setting system 100.

Figure 5:
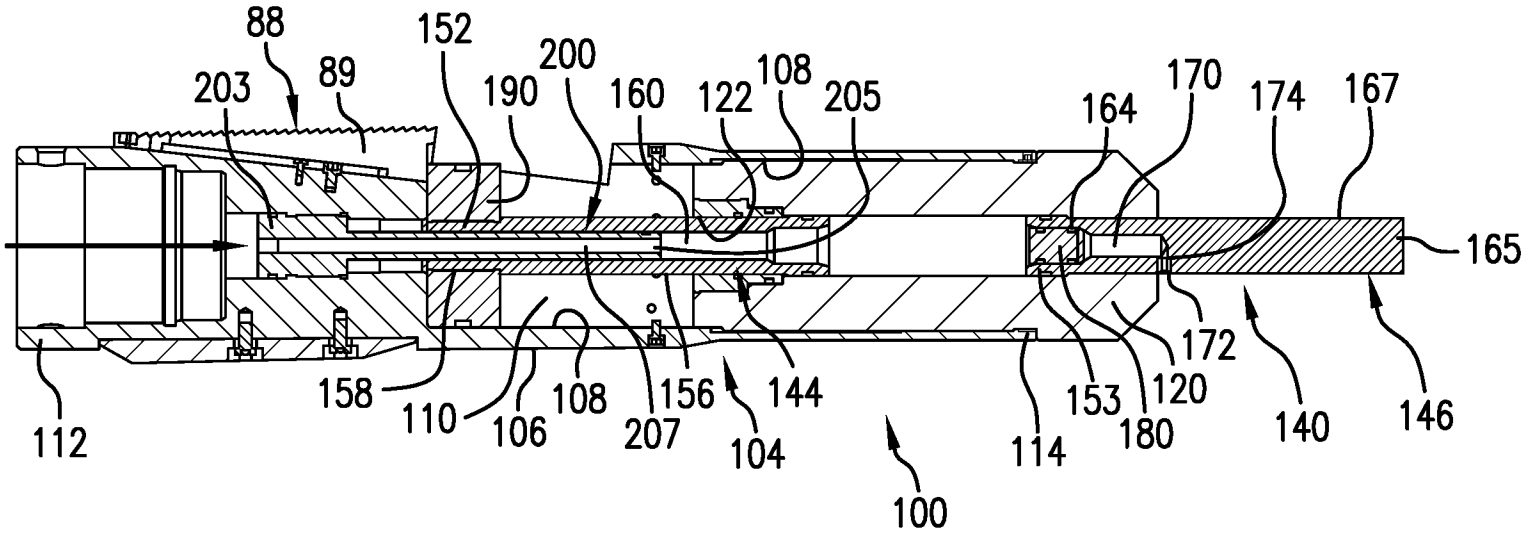
FIG. 5 depicts the setting system during a tubular pressure setting, in accordance with an exemplary embodiment.

Referring to FIG. 5, in the event that the first setting methodology fails, such as due to a failure of burst disc 174 to rupture, pressure may be increased within tubular string 30. The fluid pressure travels down through tubular string 30 and passes into first axial end 203 of guide member 200. The fluid pressure then flows into first conduit 160 forcing shuttle 180 into second conduit 170. The fluid pressure then exists second end section 153 forcing first piston element 144 axially upwardly breaking the shear screws and driving activator 190 into connect with slip 89.

Activator 190 urges slip 89 along an angled surface portion (not separately labeled) of outer surface 106. Slip 89 expands radially outwardly into contact with annular wall 38 to maintain tubular string 30 at a desired position. Operators will shift tubular sting 30 in wellbore 34 to sense whether anchor 88 has been set. If tubular string 30 moves, a third setting methodology may be employed without the need to remove tubular sting 30 from wellbore 34 or reconfigure anchor setting system 100.

Figure 6:
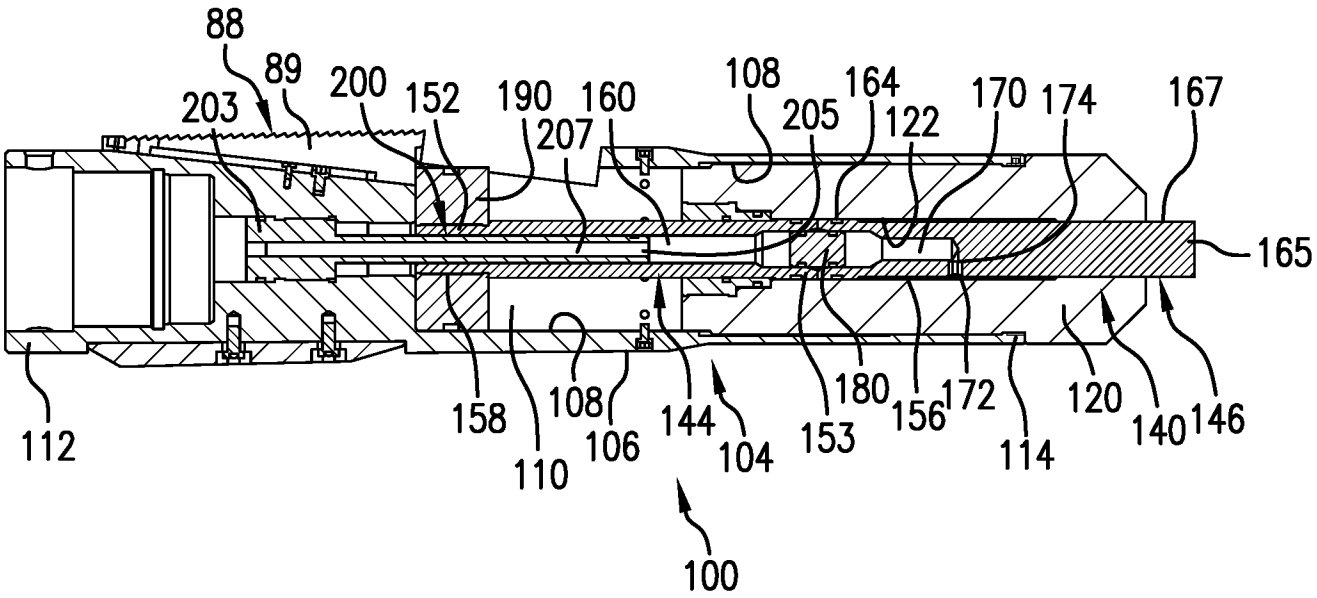
FIG. 6 depicts the setting system during a mechanical setting, in accordance with an exemplary embodiment.

Referring to FIG. 6, in the event that the second setting methodology fails, such as due to a failure of piston assembly 140 to shift, the third setting methodology may be employed. In this case, tubular string 30 is shifted further into wellbore 34. Anchor setting system 100 is brought into contact with a surface of wellbore 34, such as toe 42, causing piston assembly 140 to shift axially upwardly breaking the shear screws and driving activator 190 into connect with slip 89. As discussed herein, activator 190 urges slip 89 along an angled surface portion (not separately labeled) of outer surface 106. Slip 89 expands radially outwardly into contact with annular wall 38 to maintain tubular string 30 at a desired position.

In accordance with an exemplary embodiment, anchor setting system 100 may be employed in a window milling operation. After being deployed into wellbore 34 to a selected position, an setting force is delivered to piston assembly 140 to shift slip(s) 89 along whipstock 84. Slip(s) 89 are shifted into contact with casing tubular 40 by activator 190. After shifting slips(s) 89 into contact with casing tubular 40, anchor 88 is moved to position whipstock 84 at a selected orientation and position along casing tubular 40. At this point, set down weight may be applied to lock slips (84) to casing tubular 40 and window mill 80 deployed to form a casing window.

After milling the casing window into casing tubular 40, whipstock 84 can be released from wellbore casing 40 by applying an overpull force to tubular string 30. At this point, whipstock 84 may be relocated higher in wellbore 34 to initiate another window milling operation. Whipstock 84 may be locked in place through anchor 88 by re-applying set down weight. At the higher location, whipstock 84 may be at a different angular orientation. The angular position of whipstock 84 may be determined by MWD system 65 or another telemetry system. At this point, the other window may be milled into casing tubular 40.

Figure 7:
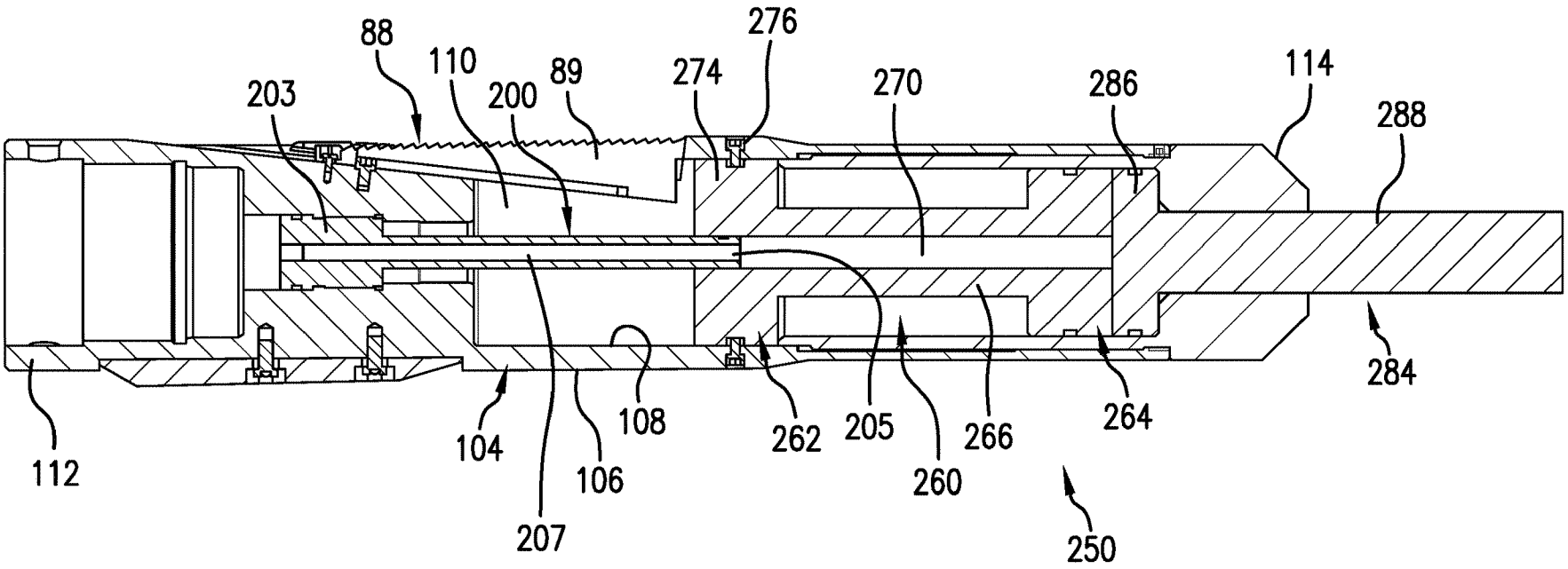
FIG. 7 depicts a setting system in a run-in configuration, in accordance with another aspect of an exemplary embodiment.

Reference will now follow to FIG. 7, wherein lie reference numbers represent corresponding parts in the respective views, in describing an anchor setting system 250 in accordance with another aspect of an exemplary embodiment. Anchor setting system 250 includes a piston assembly 260 arranged in internal chamber 110. Piston assembly 260 includes a first piston element 262 and a second piston element 264 joined by a connecting element 266. A passage 270 extends through piston assembly 260 from first piston element 262 through second piston element 264. First piston element 262 may take the form of an activator 274 that may selectively engage and set slip 89. Activator 274 is retained in interior chamber 110 through one or more shear members 276.

Piston assembly 260 also includes an activator member 284 that includes a third piston element 286 mounted to a rod 288, in a manner similar to that described above, tubular string 30 is run into wellbore 34 to position window mill 80 at a selected depth. Once in position, fluid pressure may be increased within tubular string 30. The fluid pressure travels down through tubular string 30 and passes into first axial end 203 of guide member 200. The fluid pressure then flows into passage 270 and acts against third piston element 286 causing piston assembly 260 to travel axially upwardly breaking shear members 276 causing first piston element 262 to act upon slip 89. At this point, it should be understood that while shown as a separate component, activator member 284 may be integrated with first piston element 262 and second piston element 264.

First piston element 262 urges slip 89 along an angled surface portion (not separately labeled) of outer surface 106. Slip 89 expands radially outwardly into contact with annular wall 38 to maintain tubular string 30 at a desired position. Operators will shift tubular sting 30 in wellbore 34 to sense whether anchor 88 has been set. If tubular string 30 moves, another setting methodology may be employed without the need to remove tubular sting 30 from wellbore 34 or reconfigure anchor setting system 200.

In a manner similar to that described herein, in the event the first setting methodology does not set anchor 88, tubular string 30 is shifted further into wellbore 34. Rod 288 is brought into contact with a bottom of wellbore 34 causing piston assembly 260 to shift axially upwardly breaking the shear screws and connecting with slip 89. As discussed herein, first piston element 262 urges slip 89 along an angled surface portion (not separately labeled) of outer surface 106. Slip 89 expands radially outwardly into contact with annular wall 38 to maintain tubular string 30 at a desired position.

At this point, it should be appreciated that the exemplary embodiments describe a system for setting a downhole anchor using redundant setting methodologies. The particular order of the setting methodologies may vary. Further the number of setting methodologies attempted for any given anchor setting operation may vary. That is the anchor setting system may be deployed once and, in the event that a primary setting methodology fails to set the anchor, one or more backup setting methodologies may be employed without the need to remove the tubular string from the wellbore or reconfigure the anchor setting system.

Set forth below are some embodiments of the foregoing disclosure:

Embodiment 1. An anchor setting system having redundant setting methodologies, the anchor setting system comprising: a housing including an internal chamber, the housing having an outer surface, an inner surface, a first end, and a second end; a slip shiftably mounted to the outer surface of the housing; a piston assembly including a piston element arranged in the housing, the piston element including a conduit and is shiftably mounted in the internal chamber; and an activator mounted to the piston assembly, the activator selectively shifting the slip axially along the housing in response to movement of the piston element.

Embodiment 2. The anchor setting system according to any prior embodiment, wherein the piston element includes a first piston element including a first conduit and a second piston element including a second conduit that fluidically registers with the first conduit, the first piston element being axially shiftable relative to the second piston element.

Embodiment 3. The anchor setting system according to any prior embodiment, further comprising: a shuttle arranged in one of the first conduit and the second conduit.

Embodiment 4. The anchor Setting system according to any prior embodiment, further comprising: an opening extending radially through the second piston element and fluidically connected to the second conduit.

Embodiment 5. The anchor setting system according to any prior embodiment, further comprising: a burst disc arranged in the opening.

Embodiment 6. The anchor setting system according to any prior embodiment, further comprising: a guide member arranged in the internal chamber, the guide member including a first axial end fixedly mounted to the housing and a second axial end that extends into the conduit.

Embodiment 7. The anchor setting system according to any prior embodiment, wherein the piston element includes a first piston element mechanically connected to a second piston element by a connecting element, the conduit extending through the first piston element, the second piston element and the connecting element.

Embodiment 8. The anchor setting system according to any prior embodiment, wherein the first piston element defines the activator.

Embodiment 9. The anchor setting system according to any prior embodiment, further comprising an activator member including a third piston element arranged in the housing and a rod that extends from the third piston element axially outwardly of the housing.

Embodiment 10. The anchor setting system according to any prior embodiment, wherein the housing is mechanically connected to a whipstock.

Embodiment 11. The anchor setting system according to any prior embodiment, further comprising: a tubular mechanically connected to the housing, the tubular supporting at least one of a brush and a scraper for cleaning internal surfaces of a wellbore casing.

Embodiment 12. A method of activating an anchor in a wellbore comprising: introducing a first setting force to an anchor setting system; sensing that the first setting force did not set the anchor; and introducing a second setting force without reconfiguring the anchor setting system to set the anchor.

Embodiment 13. The method according to any prior embodiment, wherein introducing the first setting force includes increasing annular pressure about the anchor setting system.

Embodiment 14. The method according to any prior embodiment, further comprising: rupturing a burst disc with the annular pressure.

Embodiment 15. The method according to any prior embodiment, further comprising: urging a first piston element axially away from a second piston element with the annular pressure.

Embodiment 16. The method according to any prior embodiment, further comprising: urging a first piston element and a second piston element axially toward a slip with the annular pressure.

Embodiment 17. The method according to any prior embodiment, further comprising: shifting a setting member supported on the first piston element into contact with a slip of the anchor.

Embodiment 18. The method according to any prior embodiment, wherein introducing the second setting force includes increasing internal pressure of a tubular supporting the anchor.

Embodiment 19. The method according to any prior embodiment, further comprising: urging a first piston element axially away from a second piston element with the internal pressure.

Embodiment 20. The method according to any prior embodiment, further comprising: shifting a setting member supported on the first piston element into contact with a slip of the anchor.

Embodiment 21. The method according to any prior embodiment, further comprising: shifting a first piston element and a second piston element axially away from a third piston element with the internal pressure.

Embodiment 22. The method according to any prior embodiment, wherein introducing the second setting force includes increasing annular pressure in the wellbore and shifting an activator into contact with the slip.

Embodiment 23. The method according to any prior embodiment, wherein the introducing the first setting force includes directing fluid pressure into a tubular supporting the anchor.

Embodiment 24. The method according to any prior embodiment, wherein introducing the second setting force includes contacting a portion of anchor setting system with a surface of the wellbore.

Embodiment 25. The method according to any prior embodiment, wherein introducing the second setting force includes introducing a setting force that is distinct from the first setting force.

Embodiment 26. The method according to any prior embodiment, further comprising: sensing that the second setting force did not set the anchor; and introducing a third setting force without reconfiguring the anchor setting system to set the anchor.

Embodiment 27. The method according to any prior embodiment, wherein introducing the third setting force includes contacting a piston element with a surface of the wellbore; and shifting another piston element with the piston element to set the anchor.

Embodiment 28. The method according to any prior embodiment, further comprising: milling a window in a casing tubular.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor setting system having redundant setting methodologies, the anchor setting system comprising:

a housing including an internal chamber, the housing having an outer surface, an inner surface, a first end, and a second end;

a slip shiftably mounted to the outer surface of the housing;

a piston assembly including a first piston element including a first conduit and a second piston element including a second conduit that fluidically registers with the first conduit, the first piston element being axially shiftable relative to the second piston element in the internal chamber; and an activator mounted to the piston assembly, the activator selectively shifting the slip axially along the housing in response to movement of the piston element.

2. The anchor setting system according to claim 1, further comprising: a shuttle arranged in one of the first conduit and the second conduit.

3. The anchor setting system according to claim 1, further comprising: an opening extending radially through the second piston element and fluidically connected to the second conduit.

4. The anchor setting system according to claim 3, further comprising: a burst disc arranged in the opening.

5. The anchor setting system according to claim 1, further comprising: a guide member arranged in the internal chamber, the guide member including a first axial end fixedly mounted to the housing and a second axial end that extends into the conduit.

6. The anchor setting system according to claim 1, wherein the housing is mechanically connected to a whipstock.

7. The anchor setting system according to claim 1, further comprising:

a tubular mechanically connected to the housing, the tubular supporting at least one of a brush and a scraper for cleaning internal surfaces of a wellbore casing.

8. An anchor setting system having redundant setting methodologies, the anchor setting system comprising:

a housing including an internal chamber, the housing having an outer surface, an inner surface, a first end, and a second end;

a slip shiftably mounted to the outer surface of the housing;

a piston assembly including a first piston element mechanically connected to a second piston element by a connecting element, the conduit extending through the first piston element, the second piston element and the connecting element, the first piston element and the second piston element being shiftable within the internal chamber; and an activator mounted to the piston assembly, the activator selectively shifting the slip axially along the housing in response to movement of the piston element.

9. The anchor setting system according to claim 8, wherein the first piston element defines the activator.

10. The anchor setting system according to claim 9, further comprising an activator member including a third piston element arranged in the housing and a rod that extends from the third piston element axially outwardly of the housing.

11. A method of activating an anchor in a wellbore comprising:

introducing a first setting force to an anchor setting system by increasing annular pressure about the anchor setting system;

sensing that the first setting force did not set the anchor; and introducing a second setting force without reconfiguring the anchor setting system to set the anchor.

12. The method of claim 11, further comprising: rupturing a burst disc with the annular pressure.

13. The method of claim 11, further comprising: urging a first piston element axially away from a second piston element with the annular pressure.

14. The method of claim 11, further comprising: urging a first piston element and a second piston element axially toward a slip with the annular pressure.

15. The method of claim 14, further comprising: shifting a setting member supported on the first piston element into contact with a slip of the anchor.

16. The method of claim 15, wherein introducing the second setting force includes increasing internal pressure of a tubular supporting the anchor.

17. The method of claim 16, further comprising: urging a first piston element axially away from a second piston element with the internal pressure.

18. The method of claim 16, further comprising: shifting a setting member supported on the first piston element into contact with a slip of the anchor.

19. The method of claim 16, further comprising: shifting a first piston element and a second piston element axially away from a third piston element with the internal pressure.

20. The method of claim 15, wherein introducing the second setting force includes increasing annular pressure in the wellbore and shifting an activator into contact with the slip.

21. The method of claim 11, wherein the introducing the first setting force includes directing fluid pressure into a tubular supporting the anchor.

22. The method of claim 11, wherein introducing the second setting force includes contacting a portion of anchor setting system with a surface of the wellbore.

23. The method of claim 11, wherein introducing the second setting force includes introducing a setting force that is distinct from the first setting force.

24. The method of claim 11, further comprising: milling a window in a casing tubular.

25. A method of activating an anchor in a wellbore comprising:

introducing a first setting force to an anchor setting system;

sensing that the first setting force did not set the anchor;

introducing a second setting force without reconfiguring the anchor setting system to set the anchor;

sensing that the second setting force did not set the anchor; and introducing a third setting force without reconfiguring the anchor setting system to set the anchor.

26. The method of claim 25, wherein introducing the third setting force includes contacting a piston element with a surface of the wellbore; and shifting another piston element with the piston element to set the anchor.

* * * * *